United States Patent [19]

Ewald, Jr.

[11] 4,244,486

[45] Jan. 13, 1981

[54] TANK

[76] Inventor: Herbert J. Ewald, Jr., P.O. Box 519, Karnes City, Tex. 78118

[21] Appl. No.: 38,018

[22] Filed: May 11, 1979

Related U.S. Application Data

[63] Continuation of Ser. No. 920,694, Jun. 30, 1978, abandoned.

[51] Int. Cl.[3] ..... B65D 6/00; B65D 6/34; B65D 8/08

[52] U.S. Cl. ..... 220/71; 220/5 A

[58] Field of Search ..... 220/1 B, 5 A, 66, 67, 220/71, 73, DIG. 25

[56] References Cited

U.S. PATENT DOCUMENTS

| | | | |
|---|---|---|---|
| 2,501,980 | 3/1950 | Wolfe | 220/DIG. 25 |
| 2,537,219 | 1/1951 | Girton | 220/5 A |
| 2,675,940 | 4/1954 | Schmitz | 220/71 |
| 3,012,689 | 12/1961 | Harris | 220/5 A |
| 3,047,190 | 7/1962 | Bayer | 220/71 |

*Primary Examiner*—Steven M. Pollard
*Attorney, Agent, or Firm*—Marvin B. Eickenroht; Jennings B. Thompson

[57] ABSTRACT

A tank which comprises longitudinally extending bottom and side walls formed of a sheet of flexible, plastic material bent into a "U" shape and end walls formed of additional sheets of plastic material having side and bottom edges secured to the side and bottom walls of the bent sheet. The bent sheet is supported by struts spaced along both sides thereof and having inner surfaces to conform to the side walls and curved portions of the bent sheet at the intersection of such side walls and bottom wall.

7 Claims, 2 Drawing Figures

Figures 1, 2:
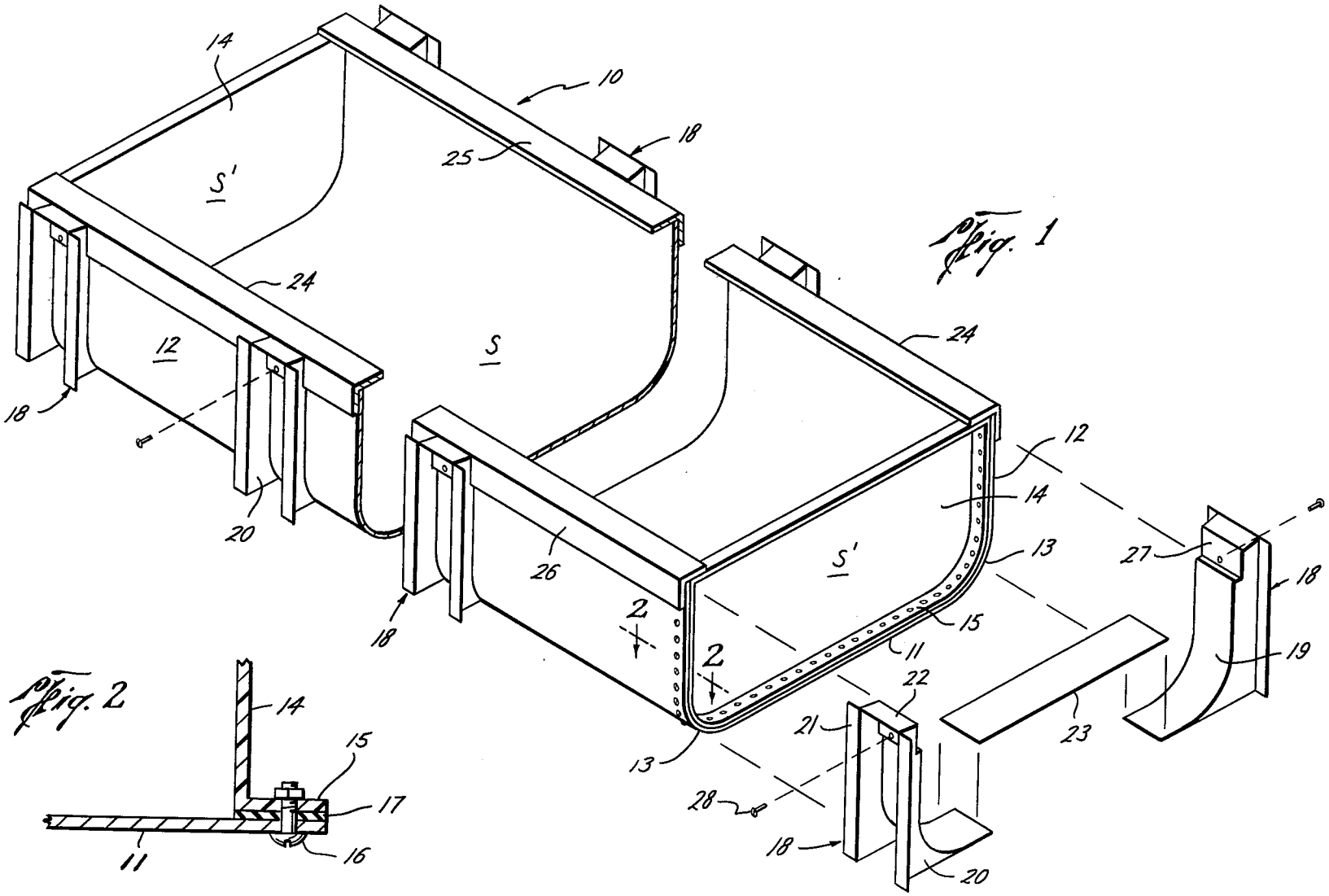

10
11
12
13
14
15
18
19
20
21
22
23
24
25
26
27
28
S
S'
2

16
17

TANK

This is a continuation, of application Ser. No. 920,694, filed June 30, 1978, now abandoned.

This invention relates generally to tanks; and, more particularly, to improvements in plastic tanks adapted for assembly in the field.

Plastic tanks find many uses not only because of their low cost, but also because of their light weight, and thus the ease by which they may be handled and/or transported. In many cases, however, tanks of this type have been sufficiently complex in both construction and assembly, due primarily to their large number of parts, as to make them unsuitable for field assembly. Also, of course, the cost of fabricating a tank of this type increases when many of the parts have different shapes requiring a large number of molds. Large numbers of parts also normally increase the overall bulk of the tank to be transported prior to assembly. Also, many prior tanks of this type require metal fasteners which are partially exposed to the interior of the tank, and are thus susceptible to corrosion and/or capable of contaminating the contents of the tank.

An object of this invention is to provide a tank of this type which is made of a minimum number of parts, particularly those having molded shapes, which may be easily and quickly assembled in the field, and which may be transported, prior to assembly, as a relatively small package.

Another object is to provide such a tank in which the various parts thereof are connected by metal fasteners which are so arranged as to be out of contact with the contents of the tank.

These and other objects are accomplished, in accordance with the illustrated embodiment of the present invention, by a tank which comprises longitudinally extending bottom and side walls formed of a sheet of flexible, plastic material bent into a "U" shape, and end walls formed of additional sheets of plastic material having side and bottom edges secured to the ends of the side and bottom walls of the bent sheet. More particularly, the bent sheet is supported by struts spaced along both sides thereof and having inner surfaces which conform to the side walls and curved portions of the bent sheet at the intersecton of such side walls and the bottom wall.

Since the sheet of plastic material forming the bottom and side walls of the tank is flexible, and thus may be bent into its desired shape, it need not be molded and instead may be a flat sheet adapted to be rolled into a relatively small diameter cylinder for storage and/or transport purposes. Furthermore, since the dimensions of the walls are controlled merely by the length and width of the flexible sheet from which they are formed, there is no need for a variety of molds for different sizes of tanks.

In the preferred and illustrated embodiment of the invention, the additional sheets forming the end walls have outturned flanges along their bottom and side edges, and fasteners extend through the flanges and adjacent end portions of the bottom and side walls to connect them to one another. Although these sheets are preferably molded in order to form the flanges thereon, they comprise only two parts of the overall tank. Furthermore, the outturned flanges permit the fasteners to extend through parts of the tank which are not exposed to the contents thereof, thus avoiding possible corrosion and contamination problems.

In the preferred and illustrated embodiment of the invention, angles extend along each side wall, with the upper flange of the angle supported on the upper edge of the side wall, and the side flange thereof depending from the upper edge of the side wall along the outer side thereof. As will be understood, the angles thus prevent the side walls of the tank from bowing outwardly a substantial amount even in the event the struts are widely spaced apart. Preferably, each strut is secured to its adjacent angle by means of fasteners, which, as in the case of the fastener at opposite ends of the tank, are not exposed to the contents thereof.

It is also preferred that the struts be arranged in oppositely facing pairs along the side walls of the tank, and that they be connected to one another, and thus held against movement away from the sides of the tank, by means which extends between them and beneath the side wall. This connecting means may, in the interest of simplicity, merely comprise a strip of plastic material welded at its opposite ends to the inner lower edges of the curved surface of the struts.

In the drawings, wherein like reference characters are used throughout to designate like parts:

FIG. 1 is a perspective view of a tank constructed in accordance with the present invention, with the intermediate portion thereof discontinued, and the struts for supporting one end of the bottom and side walls extended outwardly therefrom, all for purposes of illustration; and FIG. 2 is an enlarged sectional view, as seen along broken lines 2—2 of FIG. 1, of the connection of the end walls to the bottom and side walls of the tank.

With reference now to the details of the abovedescribed drawings, the illustrated tank, which is indicated in its entirety by reference character 10, is shown in FIG. 1 to comprise a bottom wall 11 which is joined to upright side walls 12 by longitudinally extending, curved walls 13. More particularly, these walls are formed of a single sheet S of flexible, plastic material which is bent into the desired "U" shape. As indicated by the discontinuous portion of FIG. 1, the sheet is cut to whatever size is required to form bottom and side walls of desired length, width and height. Ordinarily, sheet S is cut from flat stock, and, in any case, by virtue of being bendable, may, prior to the assembly into the "U" shape of the tank 10, be rolled into a cylinder of relatively small diameter. As previously indicated, this may be especially useful for storage and/or transport purposes, since it reduces considerably the overall bulk of at least the bottom and side wall portions of the tank.

The tank also has end walls 14 which are formed of addition sheets S' of plastic material whose side and bottom edges are secured to the ends of the side and bottom walls of the bent sheet. As shown, each sheet S' is of the same height and width as the side and bottom walls of the tank, and has flanges 15 which are turned outwardly from its bottom and side edges for fitting closely within the "U" shaped ends of the walls formed of the sheet S. When so fitted, flanges 15, and thus the end walls 14, are secured to the bottom and side walls by means of metal fasteners 16. Also, and as best shown in FIG. 2, a gasket 16 is disposed between the flanges and ends of the bottom and side walls to which they are fastened.

Flanges 15 are continuous about all four edges of the end walls 14, and thus extend outwardly from the upper edge of the top of each side wall 14. As will be appreciated, each wall 14 and its flange 15 may be formed by a relatively simple molding operation. Alternatively, if desired, each such wall may be formed of a flat sheet to which flange 15 is welded. In any event, the upper corners of sheet S' are squared so as to conform with the upper edges of side walls 12 formed from sheet S.

Sheet S is maintained in its bent shape by means of struts 18 which are spaced along both sides of the tank and which have inner surfaces which conform to the side walls and curved connecting walls of the sheet at their intersection along both sides. More particularly, each strut, which is formed of metal or relatively rigid plastic material, has an inner wall 19 on which its conforming inner surface is formed, and side walls 20 which extend perpendicularly outwardly from the inner wall, at each end thereof, to provide legs which support the strut. Preferably, each such side wall has an outturned flange 21, and a top wall 22 extends between the side walls 20 and outwardly from the upper edge of inner wall 19, all in the interest of making the strut as rigid as possible with minimum weight requirements.

As also illustrated in FIG. 1, the struts are arranged in oppositely facing pairs along the sides of the tank, and are connected by a strip 23 of plastic material extending between and welded to the inner lower edge of each side wall 19. In this way, the struts are prevented from moving away from one another under the influence of the outwardly directed force of the contents of the tank, or from being accidentally displaced from the positions shown.

As also previously described, angles 24 extend along the upper edge of each side wall from one end to the other of the tank. More particularly, the upper flange 25 of each angle is supported on the upper edge of the side wall of the tank, and at its opposite ends on flanges 15 of end walls 14, while the side flange 26 thereof depends from the upper edge of the side wall along the outer side thereof.

The upper end of the inner wall 19 of each strut is recessed at 27 so that the side flange 26 of the adjacent angle 24 may pass between it and the upper end of the side wall of the tank.

As previously described, the rigid side flange of each angle reinforces the span of the side wall between adjacent struts 18 so as to prevent it from bowing outwardly under the pressure of the contents of the tank. In this way, the adjacent struts 18 may be spaced a relatively wide distance apart, thereby conserving the number of parts and amount of material required to support the bent sheet S of the tank.

Each strut is also preferably secured to its adjacent angle by means of metal fasteners 28 extending through a hole in the recessed portion 27 at the upper end of the inner wall 19 of each strut and into the depending side flange 26 of the angle 24. In addition to fixing the location of the struts lengthwise of the tank, the fasteners 28 will assist the connecting strip 23 in preventing the struts from being moved outwardly away from the side walls of the tank.

As will be appreciated, the portion of the sheets S' forming the end walls 14 of the tank may be other than flat—for example, bowed outwardly or inwardly, as may be desired. Also, reinforcing members may extend between the side walls of the tank, or from one end wall to the other of the tank, although this is not preferred, and, in fact, one of the advantages of the novel tank of the present invention is that it is so constructed as to support its contents without obstruction of the space above its bottom wall.

As previously mentioned, all of the fasteners 16 and 28 may be of metal since none are exposed to the contents of the tank, and thus none are susceptible to corrosion or capable of contaminating.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other featuers and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A tank, comprising longitudinally extending bottom, side and curved connecting walls formed of a sheet of flexible, plastic material bent into a "U" shape, end walls formed of additional sheets of plastic material having side, bottom and curved edges secured to the ends of the side, bottom and curved walls of the bent sheet, struts having inner walls which conform to the side and curved connecting walls of the bent sheet at longitudinally spaced-apart locations along both sides thereof so as to maintain the shape of the bent sheet when the tank is filled, said struts being free of attachment to the sheet, means for preventing the struts from moving laterally away from the sides of the bent sheet, and a pair of stiffening members each having an upper flange supported on and extending along the upper edge of each side wall and a side flange depending from said edge along and adjacent only the outer side of the side wall, each said stiffening member being free of attachment to the bent sheet.

2. A tank of the character defined in claim 1, including fasteners connecting each strut to the adjacent stiffening member.

3. A tank of the character defined in claim 2, wherein the side flange of each stiffening member is disposed between the side wall of the bent sheet and the inner wall of the adjacent strut, and the fasteners connect the inner walls of the struts to the side flanges of the stiffening members.

4. A tank, comprising longitudinally extending bottom, side and curved connecting walls formed of a sheet of flexible, plastic material bent into a "U" shape, end walls formed of additional sheets of plastic material having outturned flanges along their side, bottom and curved edges, which conform to the inside of the side, bottom and curved walls of the bent sheet adjacent the ends thereof, fasteners securing said flanges to said walls, struts having inner walls which conform to the outside of the side and curved connecting walls of the bent sheet at longitudinally spaced-apart locations along both sides thereof, said struts being free of attachment to the sheet to permit them to be located at random locations along the length thereof, a pair of stiffening members each having an upper flange supported on and extending along the upper edge of a side wall of the bent sheet and a side flange depending from said edge between the side wall of the bent sheet and the inner wall of the adjacent strut, each member being free of attachment to the sheet, and the struts along each side of the bent sheet being free of attachment to one another, and means for preventing the struts from moving laterally away from the sides of the bent sheet.

5. A tank of the character defined in claim 4, including fasteners connecting the inner walls of the struts to the side flanges of the stiffening members.

6. A tank, comprising longitudinally extending bottom, side and curved connecting walls formed of a sheet of flexible, plastic material bent into a "U" shape, end walls formed of additional sheets of plastic material having outturned flanges along their side, bottom and curved edges, which conform to the inside of the side, bottom and curved walls of the bent sheet adjacent the ends thereof, fasteners securing said flanges to said walls, struts having inner walls which conform to the outside of the side and curved connecting walls of the bent sheet at longitudinally spaced-apart locations along both sides thereof, said struts being free of attachment to the sheet to permit them to be located at random locations along the length thereof, a pair of stiffening membert each having an upper flange supported on and extending along the upper edge of a side wall of the bent sheet and a side flange depending from said edge, each member being free of attachment to the sheet, and the struts along each side of the bent sheet being free of attachment to one another, and means for preventing the struts from moving laterally away from the sides of the bent sheet.

7. A tank of the character defined in claim 6, including fasteners connecting the inner walls of the struts to the side flanges of the stiffening members.

* * * * *